US006755412B1

(12) United States Patent
Glowner

(10) Patent No.: US 6,755,412 B1
(45) Date of Patent: Jun. 29, 2004

(54) HIGH SPEED OVERLAPPING INSERT FEEDING ASSEMBLY

(76) Inventor: Charles Dwayne Glowner, 1911 Forest Ave. NW., Fort Payne, AL (US) 35967

( * ) Notice: Subject to any disclaimer, the term of this patent is extended or adjusted under 35 U.S.C. 154(b) by 49 days.

(21) Appl. No.: 10/201,616

(22) Filed: Jul. 23, 2002

(51) Int. Cl.[7] ..... B65H 5/08

(52) U.S. Cl. ..... 271/12; 271/264; 271/272; 271/112

(58) Field of Search ..... 271/11, 12, 272, 271/273, 109, 264, 112, 69

(56) References Cited

U.S. PATENT DOCUMENTS

| | | | | | |
|---|---|---|---|---|---|
| 3,650,525 | A | | 3/1972 | Hageman et al. | 271/29 |
| 3,692,300 | A | | 9/1972 | Mebus | 270/55 |
| 3,698,704 | A | | 10/1972 | Hannon et al. | |
| RE28,048 | E | | 6/1974 | Hageman et al. | 271/101 |
| 3,825,247 | A | | 7/1974 | Fernandez-Rana et al. | 270/58 |
| 3,988,016 | A | | 10/1976 | Merker et al. | 270/55 |
| 4,046,369 | A | | 9/1977 | Kluge et al. | 271/3.1 |
| 4,320,894 | A | * | 3/1982 | Reist et al. | 271/277 |
| 4,477,067 | A | | 10/1984 | Wise | 270/55 |
| 4,478,399 | A | | 10/1984 | Morin et al. | |
| 4,549,729 | A | | 10/1985 | Hoffstetter et al. | 270/53 |
| 4,666,141 | A | | 5/1987 | Labombarde | 271/35 |
| 4,667,950 | A | | 5/1987 | Linder et al. | 271/245 |
| 4,735,600 | A | * | 4/1988 | Drewke et al. | 493/314 |
| 4,762,314 | A | | 8/1988 | Harada | 271/267 |
| 4,911,421 | A | | 3/1990 | Hannon | 271/161 |
| 4,988,086 | A | | 1/1991 | Schlough | 270/55 |
| 5,150,891 | A | | 9/1992 | Svyatsky et al. | 271/35 |
| 5,286,016 | A | | 2/1994 | Franks | |
| 5,398,920 | A | | 3/1995 | Leu | |
| 5,465,825 | A | | 11/1995 | Levaro et al. | 198/444 |
| 5,664,770 | A | * | 9/1997 | Keller | 271/3.11 |
| 5,722,655 | A | * | 3/1998 | Reist | 271/270 |
| 6,017,030 | A | | 1/2000 | Seidel et al. | 271/101.09 |
| 6,068,253 | A | | 5/2000 | Mueller et al. | 271/94 |
| 6,168,148 | B1 | | 1/2001 | Bechler et al. | 271/90 |
| 6,364,307 | B2 | * | 4/2002 | Leu | 271/11 |
| 6,554,268 | B1 | * | 4/2003 | Keller et al. | 271/11 |
| 2002/0125629 | A1 | * | 9/2002 | Keller | 271/11 |

FOREIGN PATENT DOCUMENTS

| | | | | |
|---|---|---|---|---|
| CH | Nr. 363964 | | 10/1962 | |
| DE | Nr. 278133 | | 11/1912 | |
| DE | P 19 45 501.7 | | 3/1970 | |
| JP | 60071459 A | * | 4/1985 | B65H/33/12 |

* cited by examiner

*Primary Examiner*—Donald R. Walsh
*Assistant Examiner*—Matthew J. Kohner
(74) *Attorney, Agent, or Firm*—Bradley Arant Rose & White LLP; David E. Mixon

(57) ABSTRACT

An insert feeding assembly includes an insert support, an overlapping feeding assembly, a separating assembly, and a main drive assembly. The insert support provides support for a stack of inserts, the overlapping feeding assembly converts the stack of inserts into an overlapping stream of inserts, and the separating assembly separates individual inserts from the overlapping stream and ejects these separated inserts out of the feeding assembly. The insert support includes an insert plate assembly and an insert guide assembly. The overlapping feeding assembly includes a suction cup assembly, a lap roller drive assembly, and a belt conveyor assembly. The separating mechanism includes a speed up roller assembly. The feeding assembly includes approximately 50% fewer parts than other known feeders and can operate at a printer press speed of approximately 75,000 inserts per hour.

24 Claims, 13 Drawing Sheets

HIGH SPEED OVERLAPPING INSERT FEEDING ASSEMBLY

BACKGROUND OF THE INVENTION

The present invention relates generally to insert feeding assemblies for newspaper packaging and distribution systems. More particularly, this invention pertains to an insert feeding assembly for newspaper packaging and distribution systems capable of feeding inserts at printing press speed.

Heidelberg Finishing Systems, Inc. (Heidelberg), located at 4900 Webster Street, Dayton, Ohio 45414, manufactures newspaper packaging and distribution systems for use in placing inserts into newspapers. One such system is the NR1372 Inserter and another is the NP1472A Inserter. Both of these systems include multiple insert feeding assemblies positioned above a rotating carousel of pockets. The pockets are designed to receive and hold newspapers and the feeding assemblies are designed to feed individual inserts into each newspaper.

Each insert feeding assembly includes an insert holder, a suction cup assembly, a gripping disk assembly with gripping fingers, and a timing system. The insert holder holds and supports a stack of inserts. The suction cup assembly, the gripping disk, and the gripping fingers are used to feed individual inserts from the insert holder through the feeding assembly into individual pockets passing below the feeding assembly. The suction cup assembly separates individual inserts from the stack of inserts, while the gripping disk uses its gripping fingers to grasp each separated insert, rotates to the bottom of the feeding assembly, and drops the separated inserts into the individual pockets. The timing system ensures that the suction cup assembly, the gripping disks, and the gripping fingers are properly synchronized.

The Heidelberg insert feeding assemblies have several disadvantages. The Heidelberg insert feeding assemblies cannot operate at printing press speed, which is approximately 75,000 newspapers per hour. These feeders operate at approximately 25,000 inserts per hour and can prepare approximately 25,000 newspapers per hour. Furthermore, increasing the speed of the feeders to a speed much higher than 25,000 inserts per hour causes inserts ejected out of the feeders to bounce out of the pockets passing below the feeders.

Operating at printing press speed is very desirable to newspaper publishers. A feeder assembly capable of operating at printing press speed would reduce the amount of time required to place inserts into newspapers and would allow newspaper publishers to delay the start time of the inserting process. As a result, newspaper publishers could include more current news in their newspapers.

The Heidelberg feeders cannot feed crumpled inserts without jamming. Clearing jammed inserts is time consuming and increases the time required for the inserting process.

The Heidelberg feeders are very sensitive to the timing between the suction cup assembly, the gripping disks, and the gripping fingers. In normal operation, the suction cup assembly pulls down the front edge of the insert located on the bottom of the stack of inserts in the insert holder. Simultaneously, the gripping disk rotates past the front edge of this insert and reaches back with a gripping finger to grasp the insert. If these components are not properly synchronized, the gripping finger will not be in the proper position to grasp the insert and the insert will jam in the feeder. It is time consuming to clear jams that occur and to adjust the timing of these feeders.

The Heidelberg feeders must be greased regularly during the inserting process to ensure proper timing between the suction cup assembly, the gripping disks, and the gripping fingers. This is a time consuming process that increases the amount of time required to complete the inserting process.

The suction levels generated by the suction cup assemblies of the Heidelberg feeders must be adjusted in order to properly feed inserts having different thicknesses. As mentioned previously, the Heidelberg feeders use a suction cup assembly to pull down the front edge of inserts on the bottom of the stack of inserts in the insert holder. For thin inserts, the suction level can be set at a low level, while for thicker inserts the suction level must be increased to a higher level. Adjusting the suction level in these feeders is a time consuming process that increases the overall time required to complete the inserting process.

The Heidelberg gripping disks, gripping fingers, and associated timing systems include a large number of moving parts that must be adjusted and synchronized correctly in order for these feeders to operate properly. As a result, the Heidelberg feeders are complex devices that are difficult to operate.

What is needed, then, is an insert feeding assembly that can operate at newspaper printing speed, can feed crumpled inserts without jamming, and can feed inserts having different thicknesses without adjusting the suction level of the feeder. There is also a need for a less complicated feeder that includes fewer parts and is easier to operate. Furthermore, there is a need for an insert feeder that is less sensitive to timing errors and that requires less greasing during operation.

SUMMARY OF THE INVENTION

Accordingly, one object of the present invention is to provide an insert feeding assembly that can operate at printing press speed, can feed crumpled inserts without jamming, and can feed inserts having different thicknesses without adjusting the suction level of the feeder.

Another object of the present invention is to provide a less complicated insert feeding assembly that includes fewer parts and is easier to operate.

Still another object is to provide an insert feeding assembly that is less sensitive to timing errors and requires less greasing during operation.

These and other objects, which will become apparent to someone reading this disclosure or practicing the present invention, are satisfied by an insert feeding assembly that includes an insert supporting assembly, a converting assembly, a conveying assembly, and an overlapping stream separating and ejecting assembly. The insert supporting assembly provides support for a stack of inserts, the converting assembly converts the stack of inserts into an overlapping stream of inserts, the conveying assembly moves the overlapping stream of inserts through the feeding assembly, and the overlapping stream separating and ejecting assembly separates individual inserts from the overlapping stream and ejects these separated inserts out of the feeding assembly.

The insert feeding assembly of the present invention can operate at a printing press speed of approximately 75,000 inserts per hour, can feed crumpled inserts without jamming, and can feed inserts having different thicknesses without adjusting the suction level of the feeder. The present invention also includes approximately 50% fewer parts when compared to other known feeders and, as a result, is less complex and easier to operate than other known feeders. Furthermore, the present invention is less sensitive to timing errors and does not require greasing during the inserting process.

DESCRIPTION OF THE PREFERRED EMBODIMENTS

Figure 1:
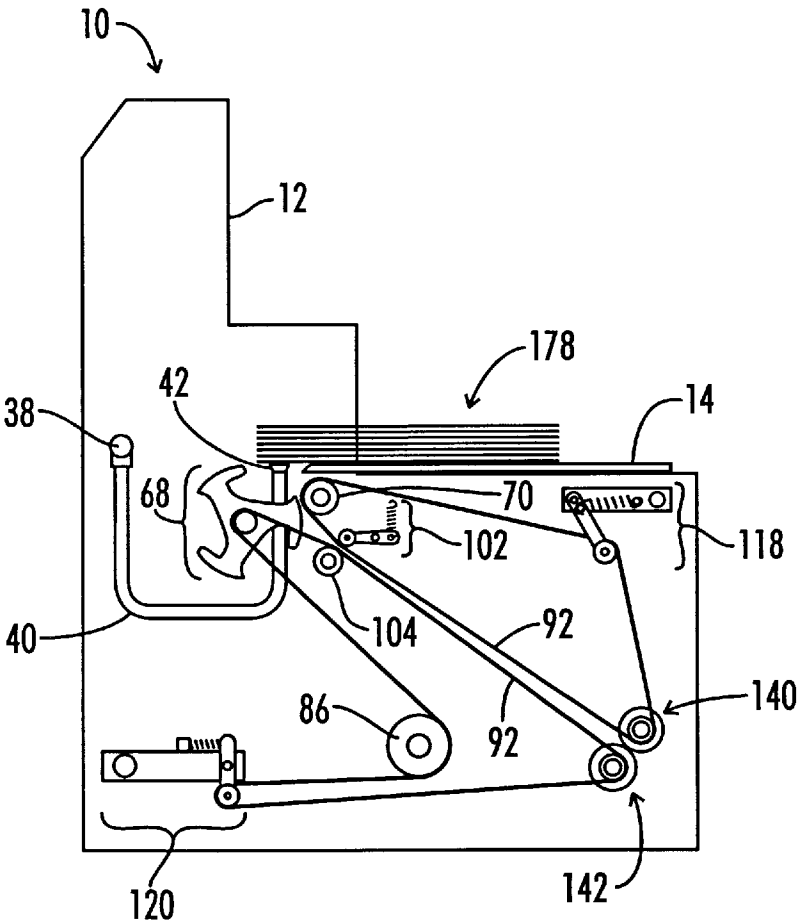
Figure 4:
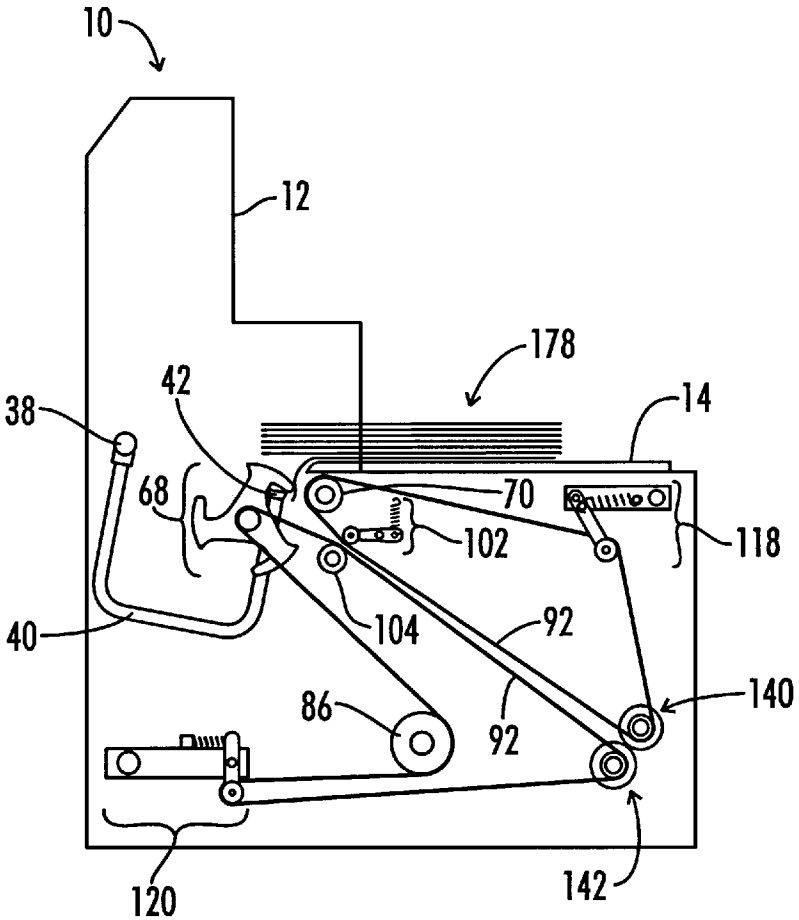
Figure 3:
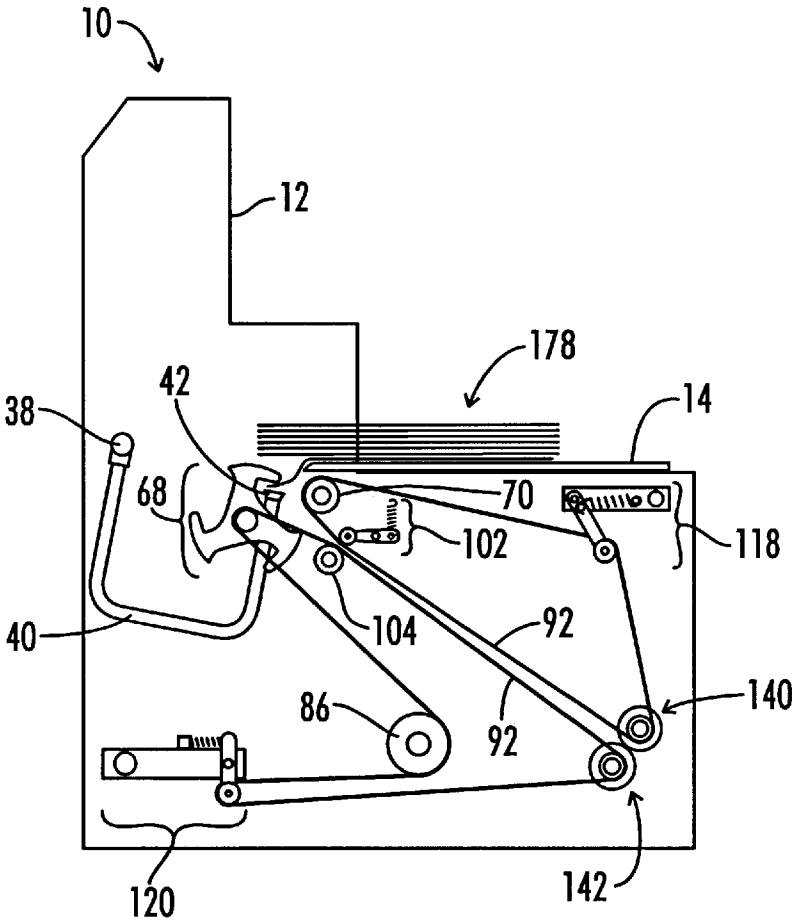

Referring to FIG. 1, the present invention of an insert feeder assembly includes a feeder frame 12, an insert supporting assembly 14, a converting assembly, a conveying assembly, an overlapping stream separating and ejecting assembly, and a main drive assembly. The feeder frame 12 encloses or provides support for all of the components of the present invention. The feeder frame 12 includes two side plates, each of which is ¾ inch thick, three braces, each of which is 1½ inches×3 inches×18½ inches, and an upper and lower portion. The lower portion has a height of approximately 15 inches, a width of approximately 5 inches, and a depth of approximately 20 inches. The upper portion has a height of approximately 12 inches, a width of 5 inches, and a depth of 20 inches, and is positioned on the left side of the feeder frame 12, inline with the lower portion of the feeder. The total height of the feeder frame 12 is approximately 27 inches.

The insert supporting assembly 14 (or insert support 14) holds and supports a stack of inserts 178. The insert support 14 includes an insert plate assembly and an insert guide assembly. The insert plate assembly can be adjusted up or down and can be tilted toward the backside of the feeder frame 12. The insert guide assembly includes front guides 26, back guides 28, and side guides 30. The stack of inserts 178 or other printed materials is placed on the insert plate assembly with the folded edge of each insert in the stack 178 extending out over the edge of the insert plate assembly and adjacent to the front guides 26. The opposite edge of each insert in stack 178 is held in place with the back guides 28, which can be adjusted to hold long or short inserts. The insert plate assembly also includes a thin metal plate (not shown) that is 1/16 inches thick, 7 inches wide, and 16 inches long, and that extends outward over the edge of the insert plate assembly toward the front guides 26. The thin metal plate gives additional support for thin and flimsy inserts. The insert plate assembly 22 supports the majority of the stack of inserts 178. Approximately 3 inches of the stack of inserts 178 is supported only by angled pins (not shown) that are located next to the front guides 26 and the folded edge of each insert in the stack 178.

Referring to FIGS. 1–13, the converting assembly converts the stack of inserts 178 into an overlapping stream of inserts and the conveying assembly feeds this stream to the overlapping stream separating and ejecting assembly located in the lower portion of the feeding assembly 10. Overlapping inserts reduces the amount of time required to feed a stack of inserts through the feeder and increases the effective feeding speed of the feeder. This increase is achieved without increasing the mechanical speed of the feeder itself. The insert feeding assembly 10 of the present invention can achieve an effective feeding speed of approximately 75,000 inserts per hour while using a mechanical speed that only produces an effective feeding speed of approximately 25,000 inserts per hour using known prior art feeders. Varying the amount of overlapping between inserts varies the effective feeding speed of the feeder of the present invention. Increasing the amount of overlapping increases the effective feeding speed and decreasing the amount of overlapping decreases the effective feeding speed.

The converting assembly includes a stack separating assembly and an overlapping and guiding assembly. The stack separating assembly includes a suction cup assembly and the overlapping and guiding assembly includes a lap roller drive assembly. The converting assembly, overlapping and guiding assembly, and the conveying assembly operate in conjunction with one another to pull and separate individual inserts from the bottom of the stack of inserts 178, overlap the separated inserts, and feed the overlapping inserts to the overlapping stream separating and ejecting assembly.

The suction cup assembly includes a suction cup shaft 38, suction 10 cup stems 40, and suction cups 42. The suction cup shaft 38 is located approximately 4 inches from the folded edge of the stack of inserts 178, 1¼ inches from the left side of the frame, and approximately two inches lower than the insert plate assembly. The suction cups 42 are approximately 7 inches apart. When placed in the fully up position, the suction cups 42 are located close to the center of the feeder 10 under the folded edge of the stack of inserts 178.

Figure 14:
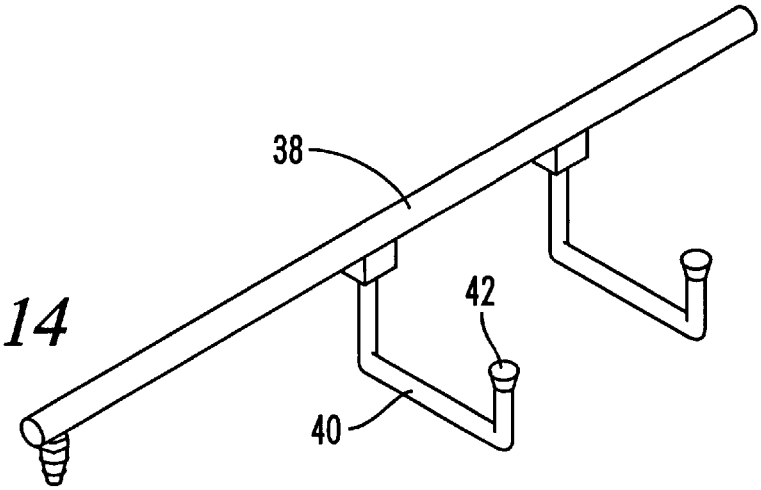
FIG. 14 is a perspective view of the suction cup assembly shown in FIGS. 1–10.

Referring to FIG. 14, each suction cup stem 40 includes three sections. The first section is approximately 4 inches long and is connected to and extends downward from the suction cup shaft 38. This section can be adjusted up or down. The second segment is approximately 4½ inches long and is connected to the first segment using a 90-degree pipefitting (not shown). The third section is approximately 3 inches long and is connected to the second section using another 90-degree pipefitting. The third section includes a nipple (not shown) that is used to connect the suction cup 42 to the third section.

Figure 27:
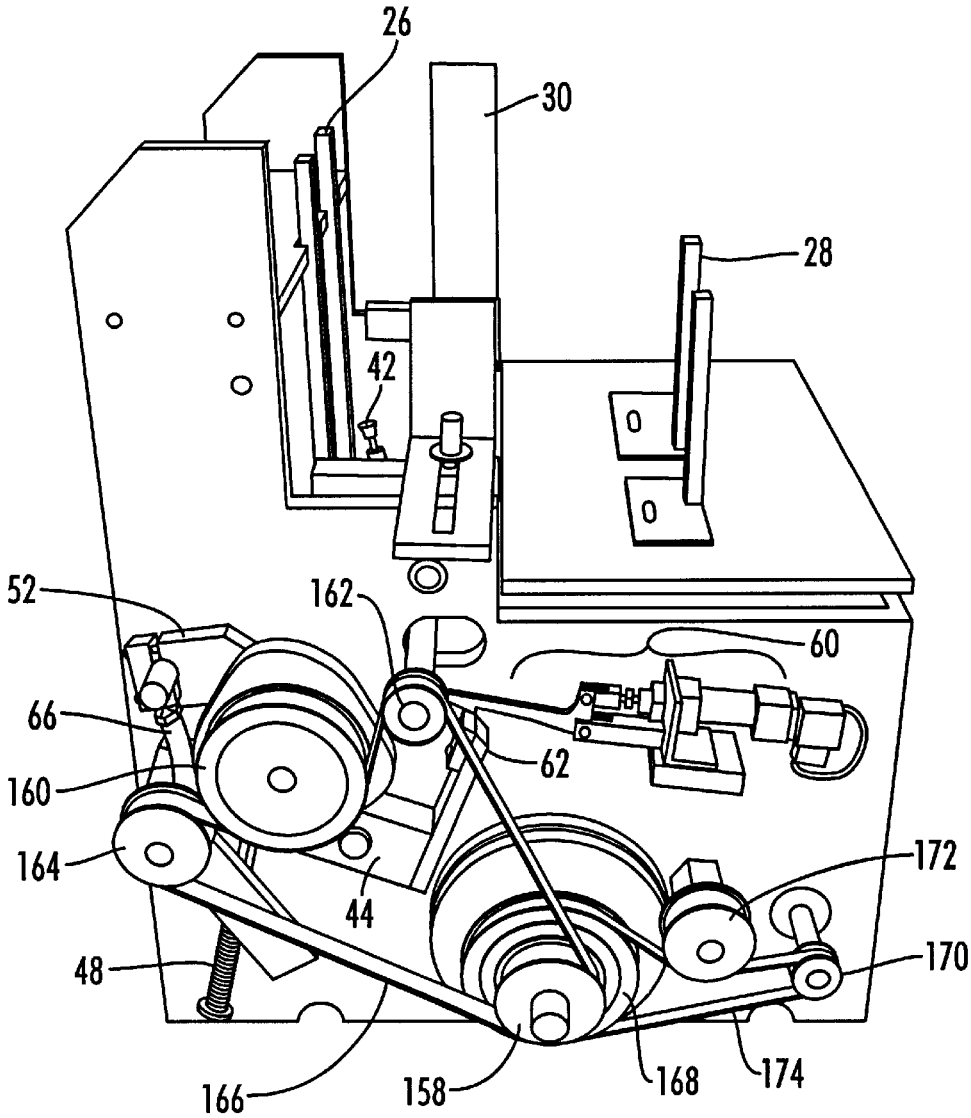
FIG. 27 is a side perspective view of the embodiment of the present invention shown in FIGS. 1–13 showing the main drive mechanism except for the lower drive roller gear and clutch assembly, which is shown in FIG. 28.
Figure 28:
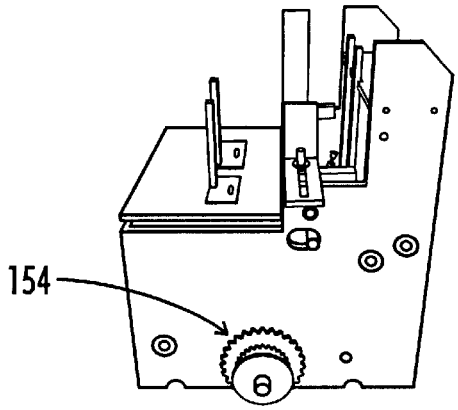
FIG. 28 is a side perspective view of the lower drive roller gear and clutch assembly of the embodiment of the present invention shown in FIG. 27.

Referring to FIG. 27, the suction cup assembly also includes a cam follower lever 44 with a cam follower, cam follower tensioning spring 48, cam, suction cup shaft lever 52, rod assembly, suction cup inhibit assembly, and vacuum assembly. The cam is used to control the movement of the suction cups 42 and is located on the lap roller assembly, which is discussed in more detail below, approximately 3'/2 inches to the right of the suction stems 40 and approximately 2 inches below the suction cup shaft 38. The cam follower, which is simply a portion of the upper surface of the cam follower lever 44 shown in FIG. 27, is pressed against the cam using the cam follower tensioning spring 48. The cam follower lever 44 has a length of approximately 7 inches and is positioned immediately below the cam. The cam follower is located approximately 2 inches from the right pivot point (the shoulder bolt shown in FIG. 27 below the right side of the cam) of the cam follower lever 44. The left end of the cam follower lever 44 is attached to a rod assembly that is approximately 5 inches long. The rod assembly is located approximately 4 inches to the left of the cam follower and includes all thread and female I bolts at each end. The rod assembly is also connected to the suction cup shaft lever 52, which is approximately 3½ inches in length and is connected to the suction cup shaft 38. The suction cup shaft lever 52 is slotted to allow an additional range of motion for this lever. This lever arrangement allows the suction cups 42 to move approximately 6 times the distance traveled by the cam follower. The suction cups 42 are in the fully up position when the cam is on the lowest or inner most portion of the cam.

Figure 17:
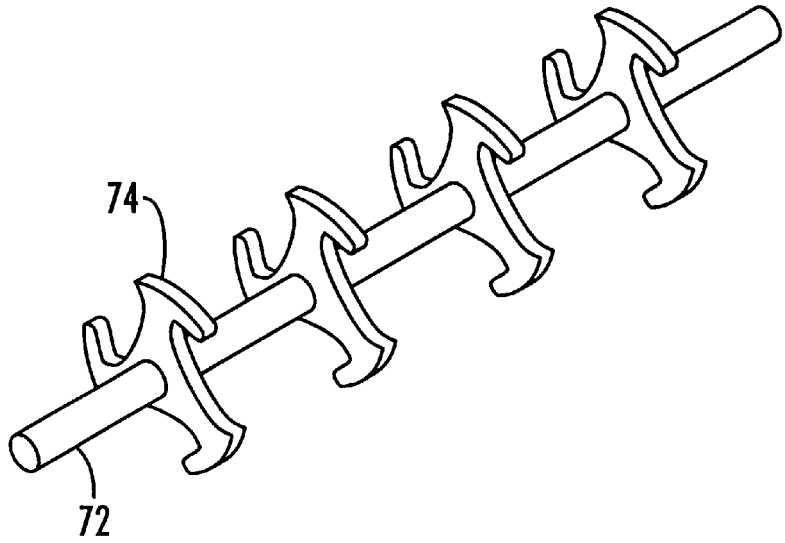
FIG. 17 is a perspective view of the lap roller assembly shown in FIGS. 1–10.
Figure 20:
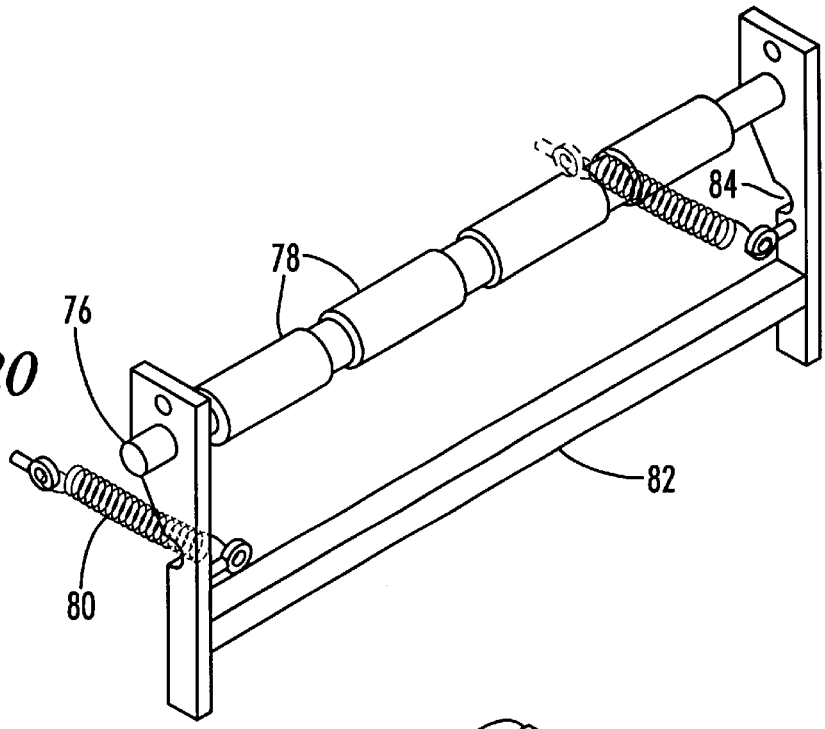
FIG. 20 is a perspective view of the upper drive roller assembly shown in FIGS. 1–10.

The inhibit assembly inhibits the operation of the suction cup assembly and includes an actuator 60 and an inhibit arm 62. To inhibit operation, the actuator 60 presses against the inhibit arm 62 and pivots the cam follower lever 44 to the right, thereby preventing the cam from engaging with the cam follower. The vacuum assembly supplies suction to the suction cup assembly and includes a vacuum source and a vacuum hose The lap roller drive assembly is shown in FIGS. 17 and 20 and includes a lap roller assembly 68 and an upper drive roller assembly 70. This assembly does not include the complicated gripping disks and gripping fingers of prior art feeders that require multiple timing cams and frequent greasing during the inserting process in order to operate properly. As a result, the present invention includes fewer parts, is easier to operate, and requires less greasing than these prior art feeders. The lap roller assembly 68 includes a lap roller shaft 72 and four lap rollers 74, spaced approximately 3 inches apart from one another. Using multiple spaced lap rollers allows the insert feeding assembly 10 to feed crumpled inserts without jamming. The lap rollers 74 are manufactured from a ½ inch thick steel plate and are approximately 6 inches in diameter. Each lap roller 74 includes three bent-finger shaped structures that are evenly spaced and approximately 120 degrees apart from one another. The use of these structures makes the present invention less sensitive to timing errors because these structures can engage inserts at various positions along the surfaces of these structures and still operate properly. Each structure has a length of approximately 3 inches, a width (or thickness) of approximately ½ inch, and a bent finger portion that has a height of approximately ⅜ inch. The outer portion of each structure is curved and the clearance between the inside part of the structure and the inner part of the lap roller shaft 72 is approximately ⅝ inch. The outer portion of each structure is used to push inserts 180 past the suction cups 42 against the upper drive roller assembly 70.

The upper drive roller assembly 70 is spring-loaded and includes an upper drive roller shaft 76, upper drive rollers 78, upper drive roller tensioning springs 80, an upper drive roller frame 82, and pivot notches 84. The upper drive roller assembly 70 is located below the insert plate assembly and above and to the right of the lap roller assembly. The upper drive rollers 78 have a 2-inch diameter and a length of 16 inches. The rollers 78 can be adjusted using the upper drive roller tensioning springs 80 so that the rollers 78 contact the lap rollers 74 or so that there is a gap between the lap rollers 74 and the upper drive rollers 78. This latter placement is used with larger inserts that require greater clearance between the lap rollers 74 and the upper drive rollers 78. When the lap rollers 74 press an insert against the upper drive rollers 78, approximately ¼ inch of the insert extends past the tip of the finger structures of the lap rollers 74. The lap rollers 74 and upper drive rollers 78 pull the inserts 180 a short distance and guide the inserts 180 into the conveyor belt assembly. One full rotation of the lap rollers 74 pulls and overlaps three inserts and feeds the overlapping inserts to the conveyor belt assembly. The lap rollers 74 and the upper drive rollers 78 are both driven by the main drive assembly, which is described in more detail below.

Figure 18:
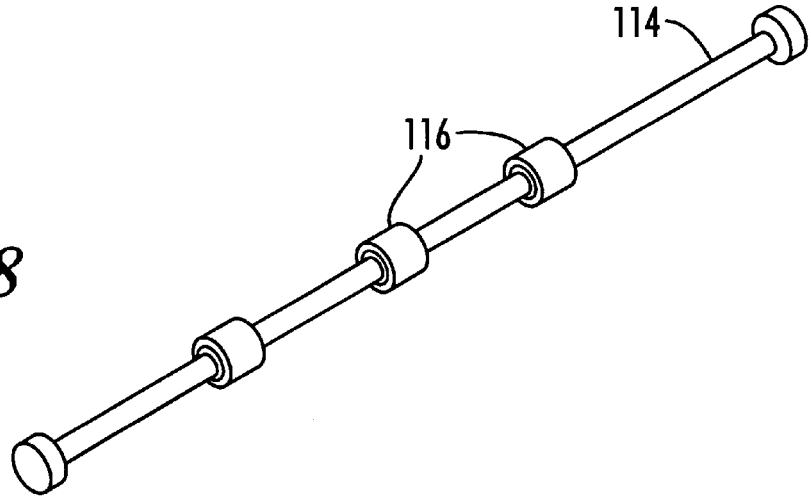
FIG. 18 is a perspective view of the lower pinch roller assembly shown in FIGS. 1–10.
Figure 19:
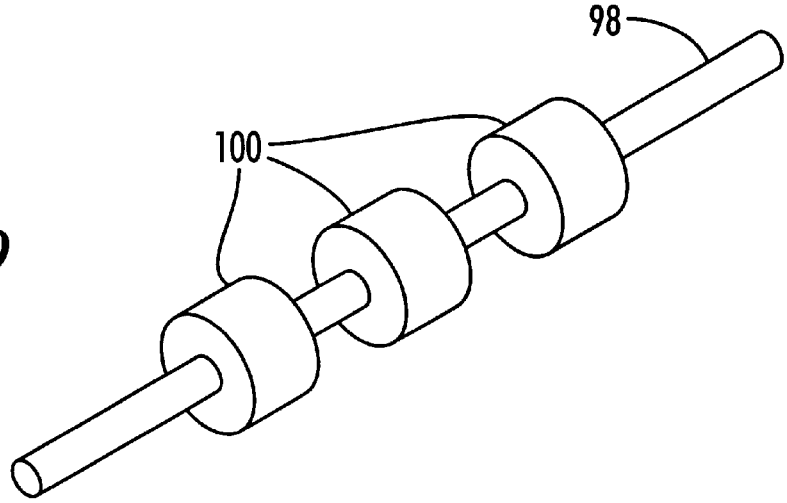
FIG. 19 is a perspective view of the lower drive roller assembly shown in FIGS. 1–13.
Figure 22:
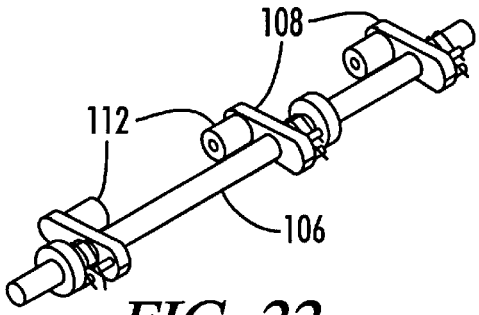
FIG. 22 is a perspective view of the upper pinch roller assembly shown in FIGS. 1–10.
Figure 23:
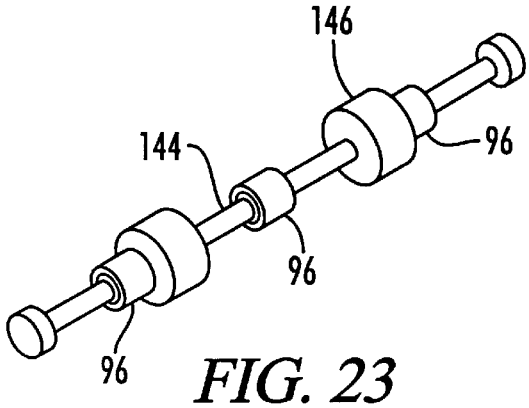
FIG. 23 is a perspective view of the upper speed up roller assembly shown in FIGS. 1–13.
Figure 24:
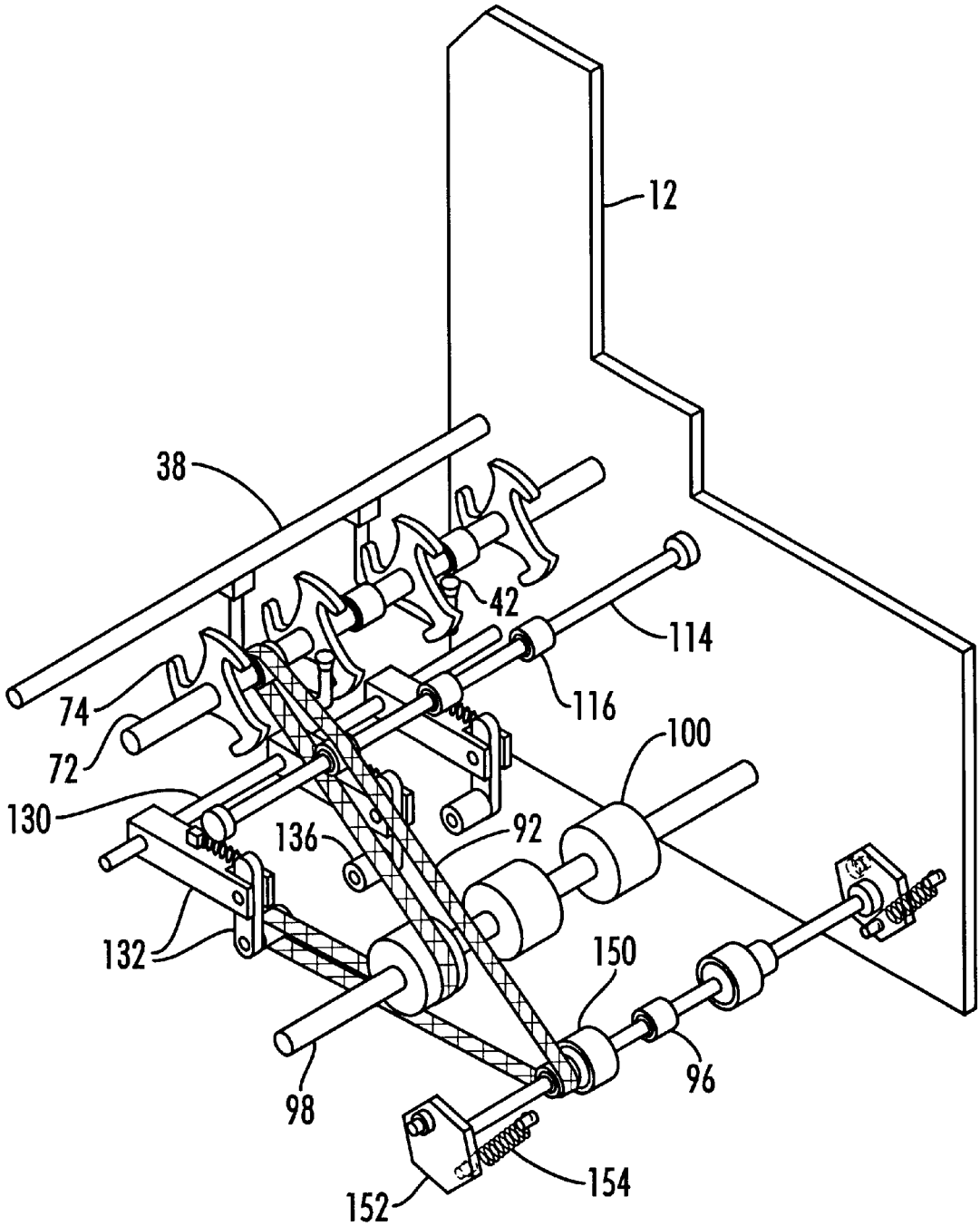
FIG. 24 is a partial perspective view of the embodiment of the present invention shown in FIGS. 1–13 showing one of the lower conveyor belts of the present invention.
Figure 25:
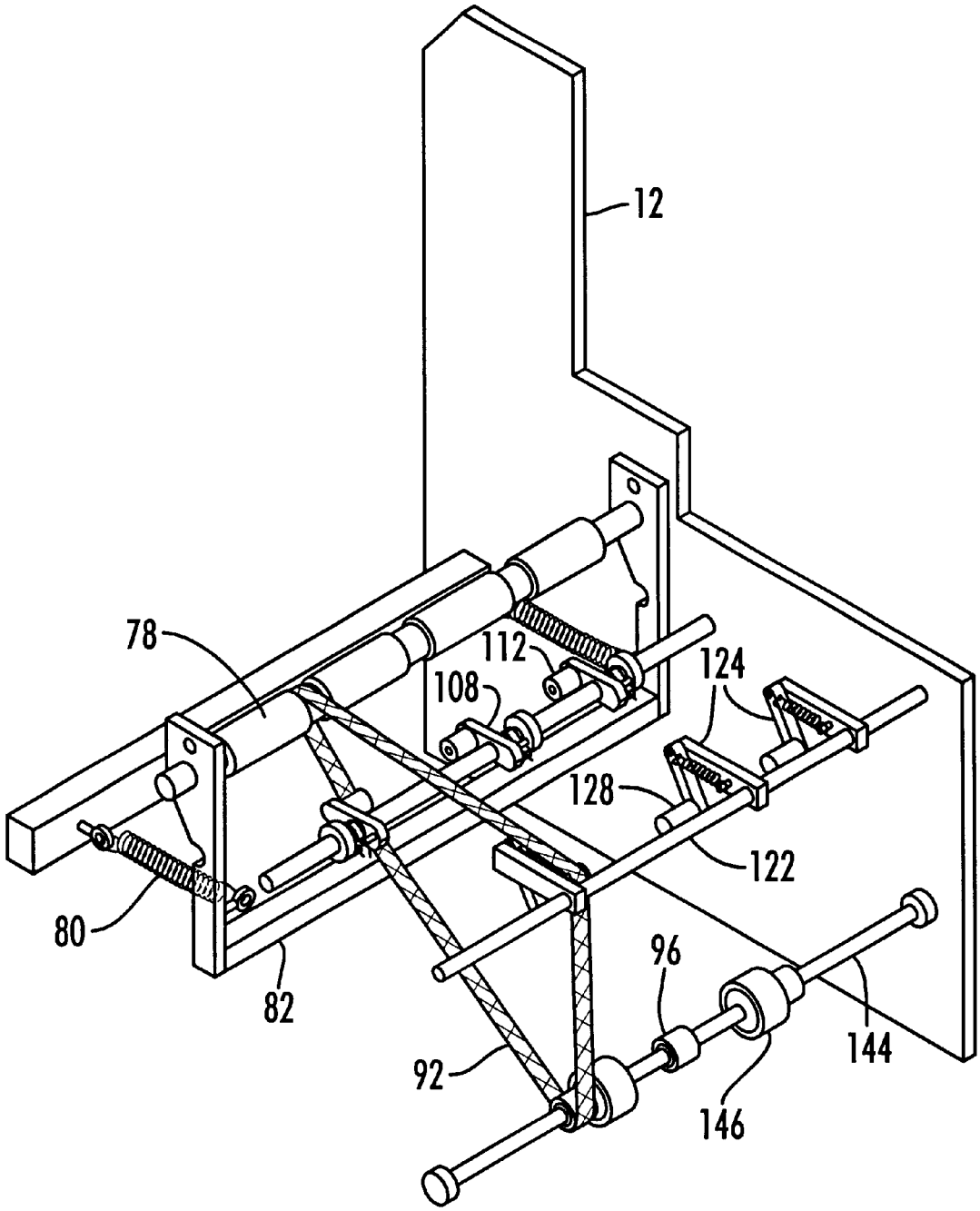
FIG. 25 is a partial perspective view of the embodiment of the present invention shown in FIGS. 1–13 showing one of the upper conveyor belts of the present invention.
Figure 26:
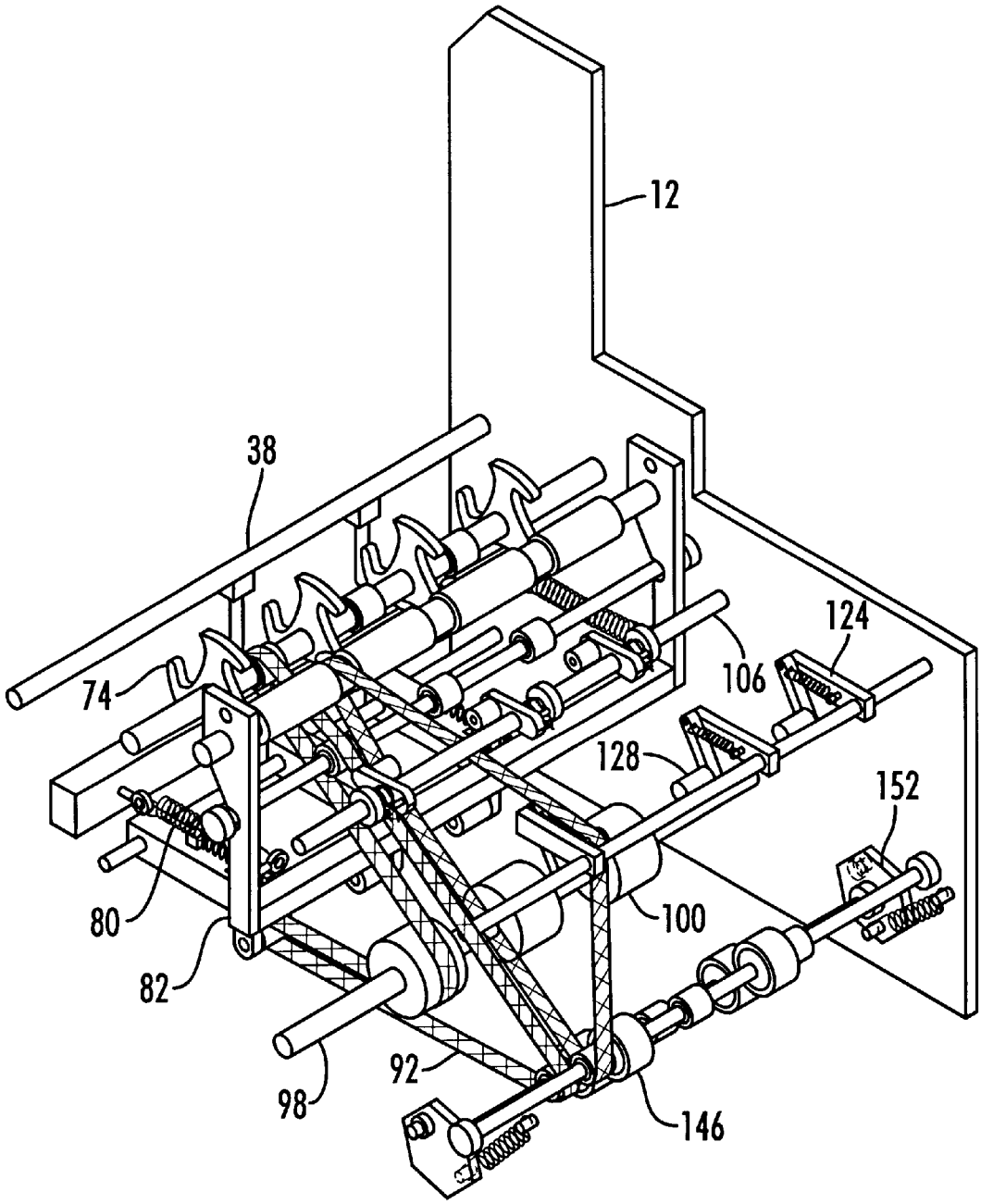
FIG. 26 is a partial perspective view generated by combining FIGS. 24 and 25.

Referring to FIGS. 24–26, the conveying assembly includes a conveyor belt assembly having a lower drive roller assembly 86, a pinch roller assembly, a conveyor belt tensioning assembly, upper and lower conveyor belts 92, 2 inch diameter lap roller bearings 94 located on the lap roller shaft 72 (see FIGS. 24 and 26), and 1⅞ inch diameter upper and lower speed up roller bearings. The lower drive assembly 86 includes a lower drive roller shaft 98 and lower drive rollers 100 (see FIG. 19). The lower drive rollers 100 have a diameter of 4 inches. The pinch roller assembly is located to the right of the lap roller assembly 68 below the upper drive roller assembly 70, and includes an upper pinch roller assembly 102 and a lower pinch roller assembly 104. The upper pinch roller assembly 102 (see FIG. 22) is spring loaded and includes an upper pinch roller shaft 106, upper pinch roller levers 108, upper pinch roller tensioning springs, and upper pinch rollers 112. The upper pinch rollers 112 have an inner diameter of ⅜ inch and a 1⅜ outer diameter. The lower pinch roller assembly 104 (see FIG. 18) includes a lower pinch roller shaft 114 and lower pinch rollers 116. The lower pinch roller shaft 114 has a diameter of ⅝ inch and the lower pinch rollers 112 have a diameter of 1⅜ inches.

The present invention includes three upper conveyor belts 92 and three lower conveyor belts 92 that are inline with one another. One of each of these belts 92 is shown in FIG. 26. The center conveyor belts 92 are located between the two inner lap rollers 74 and the two outside conveyor belts 92 are located between the two outer lap rollers 74 and the two inner lap rollers 74. The belts have a width of 1 inch and are approximately 3½ inches apart from one another.

Figure 15:
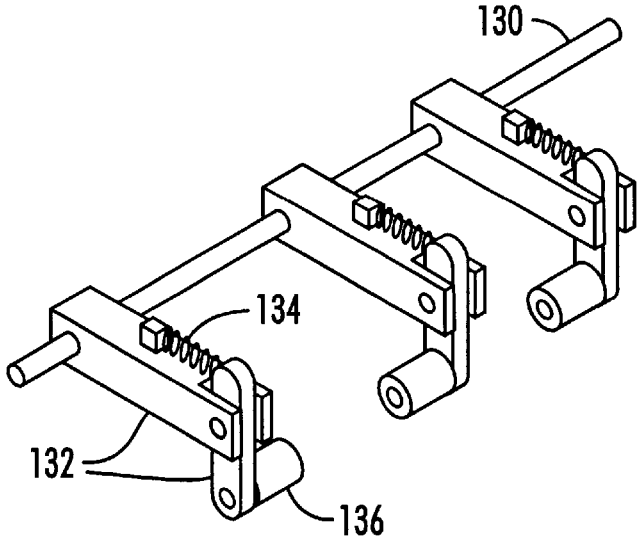
FIG. 15 is a perspective view of the lower conveyor belt tensioning assembly shown in FIGS. 1–10.
Figure 16:
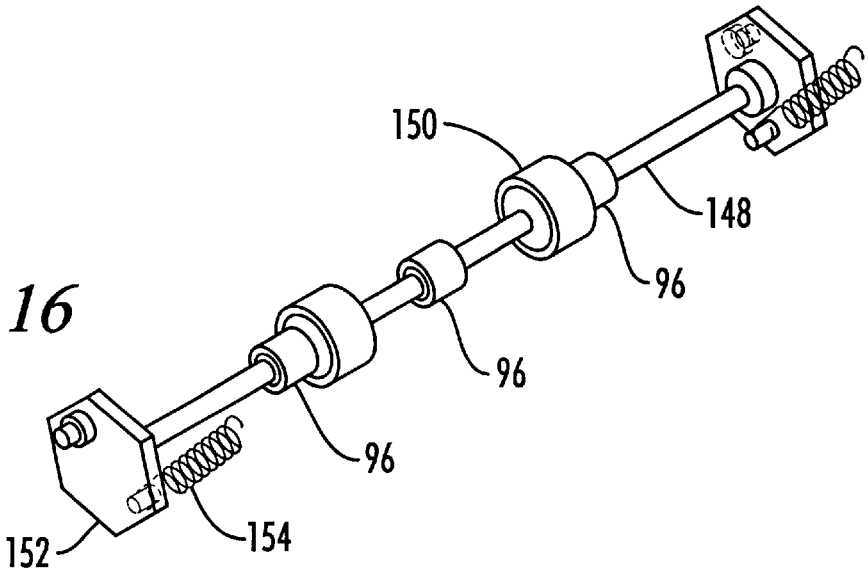
FIG. 16 is a perspective view of the lower speed up roller assembly shown in FIGS. 1–13.
Figure 21:
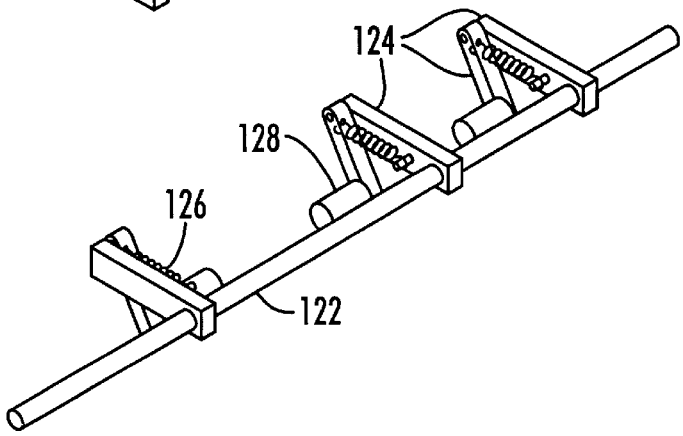
FIG. 21 is a perspective view of the upper conveyor belt tensioning assembly shown in FIGS. 1–10.

Referring to FIGS. 15 and 21, the conveyor belt tensioning assembly is used to hold tension on the conveyor belts 92 when running inserts having different thicknesses and includes an upper conveyor belt tensioning assembly 118 and a lower conveyor belt tensioning assembly 120. The upper conveyor belt tensioning assembly 118 includes an upper conveyor belt tensioning shaft 122. upper conveyor belt tensioning levers 124, upper conveyor belt tensioning springs 126, and upper conveyor belt tensioning rollers 128. The lower conveyor belt tensioning assembly 120 includes a lower conveyor belt tensioning shaft 130, lower conveyor belt tensioning levers 132, lower conveyor belt tensioning springs 134, and lower conveyor belt tensioning rollers 136.

Figure 2:
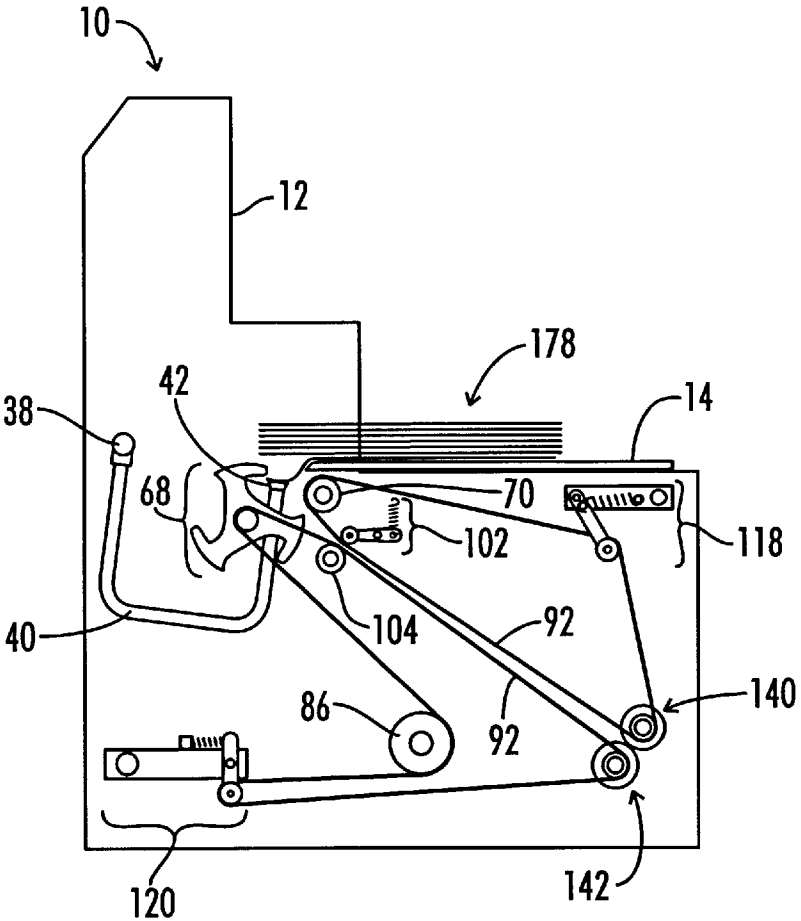
FIGS. 1–13 are sequential cut-away side views of one embodiment of the insert feeding assembly of the present invention showing how the feeding assembly converts a stack of inserts into an overlapping stream of inserts, separates individual inserts from the stream, and ejects these separated inserts from the feeding assembly.
Figure 6:
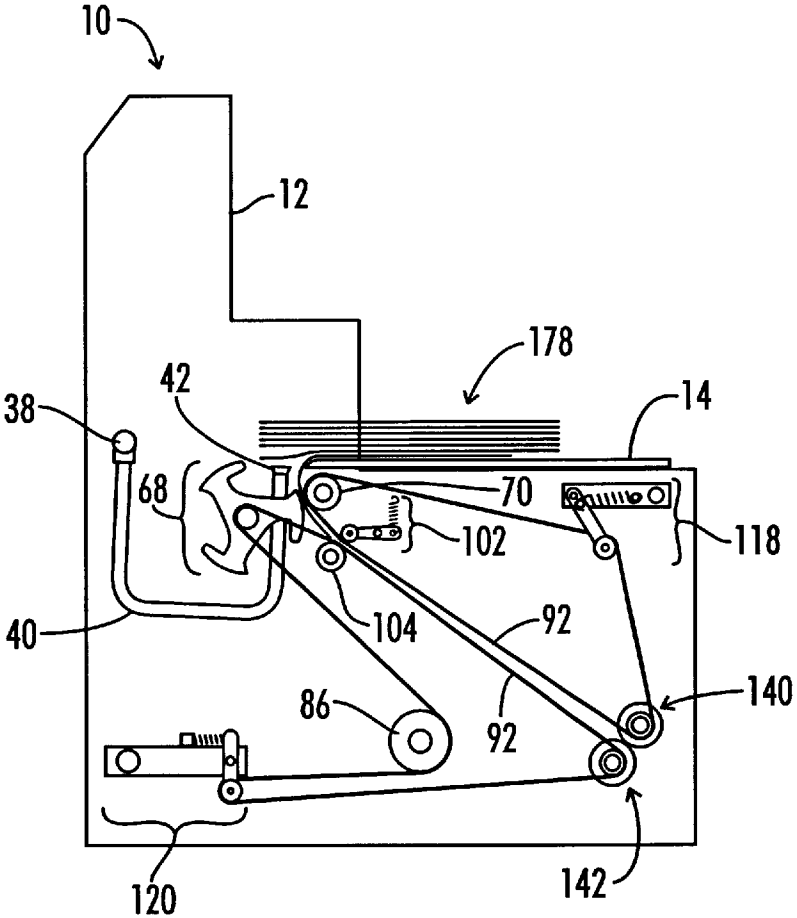
Figure 5:
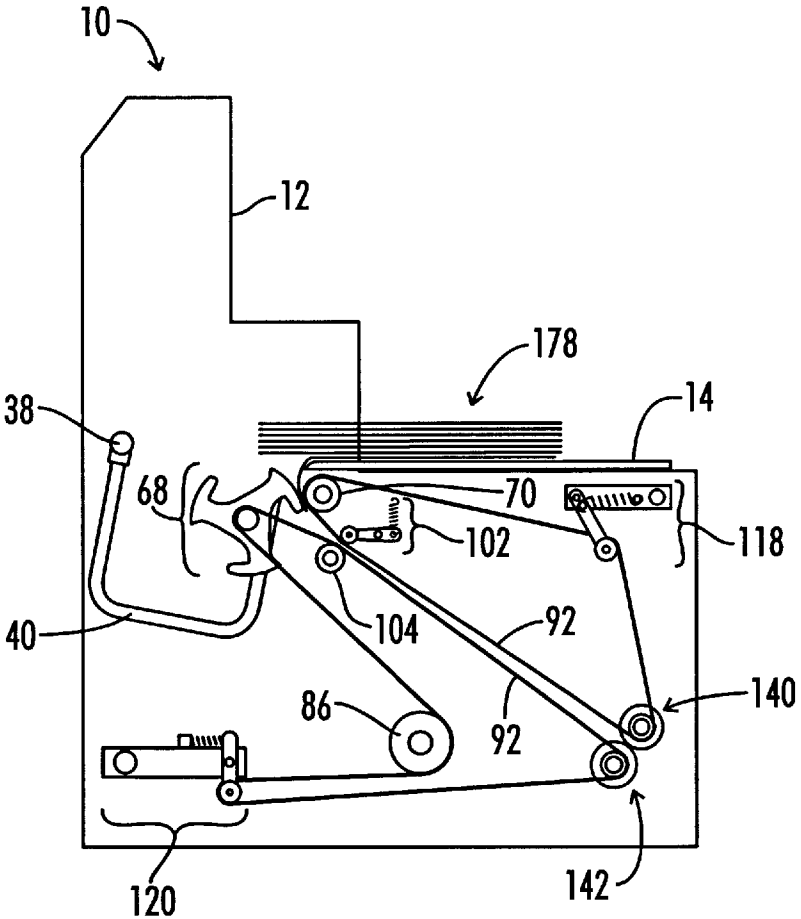
Figure 8:
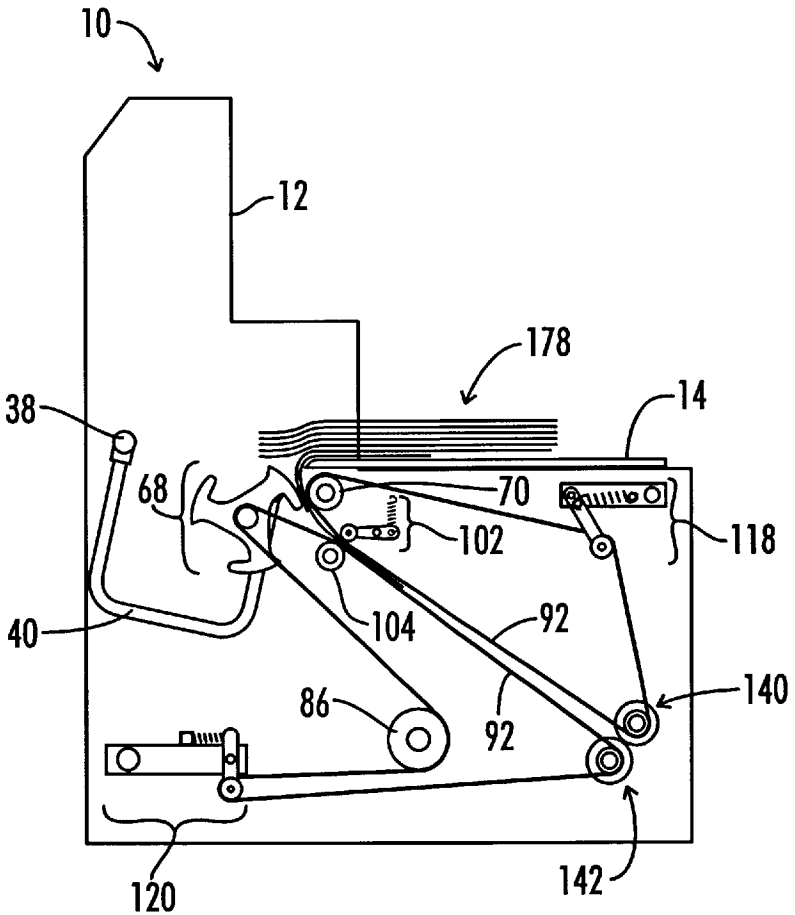
Figure 7:
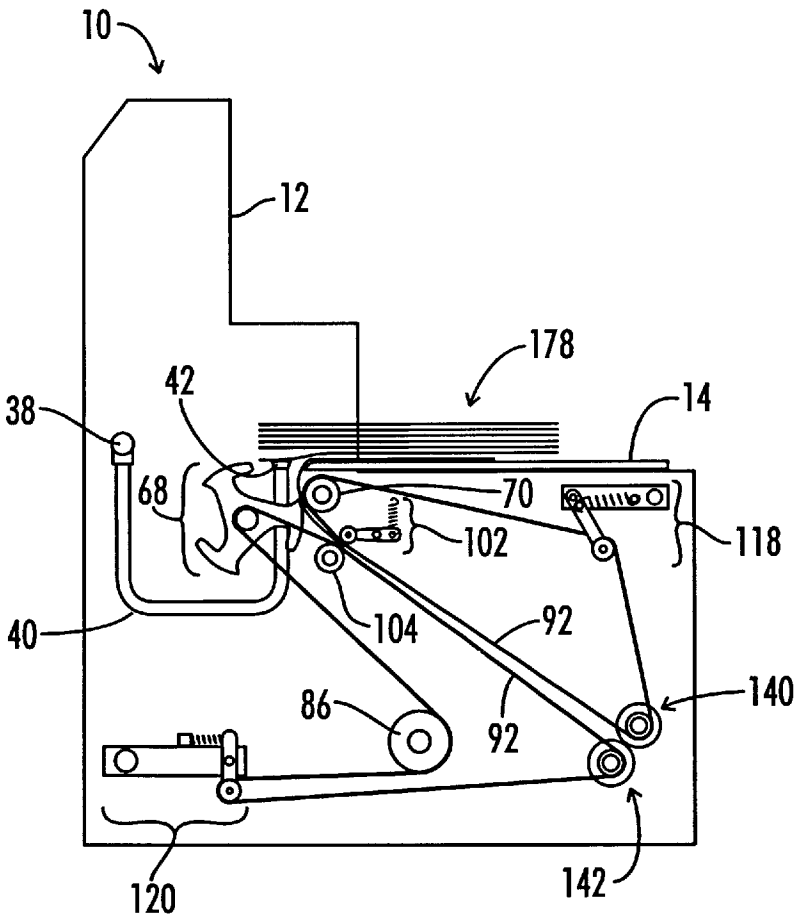
Figure 10:
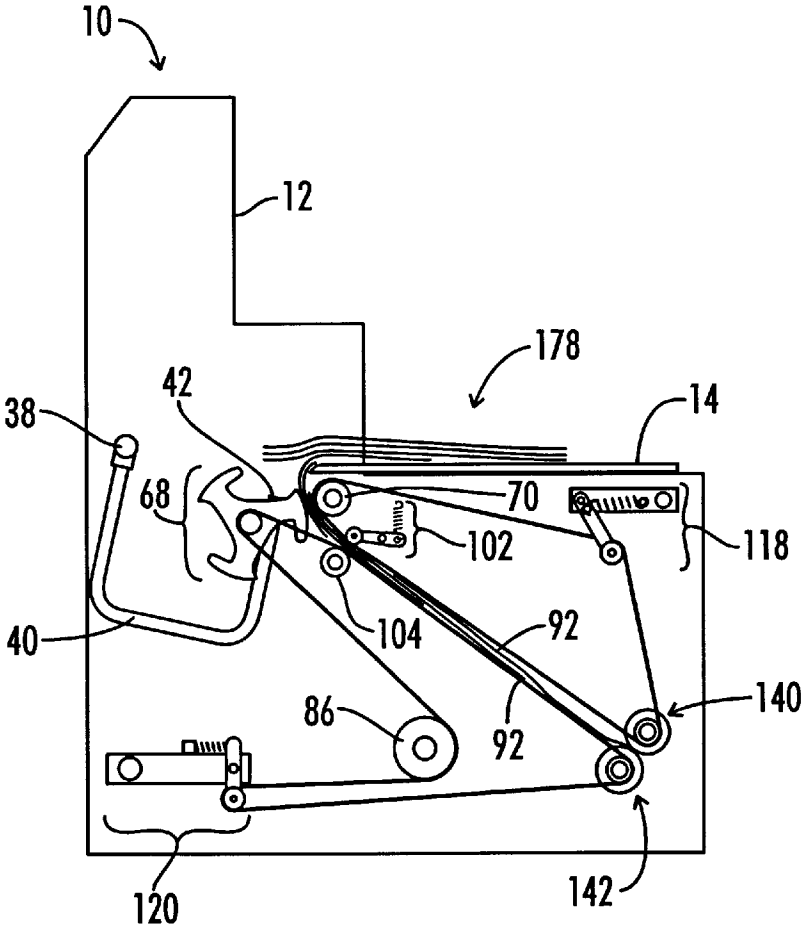
Figure 9:
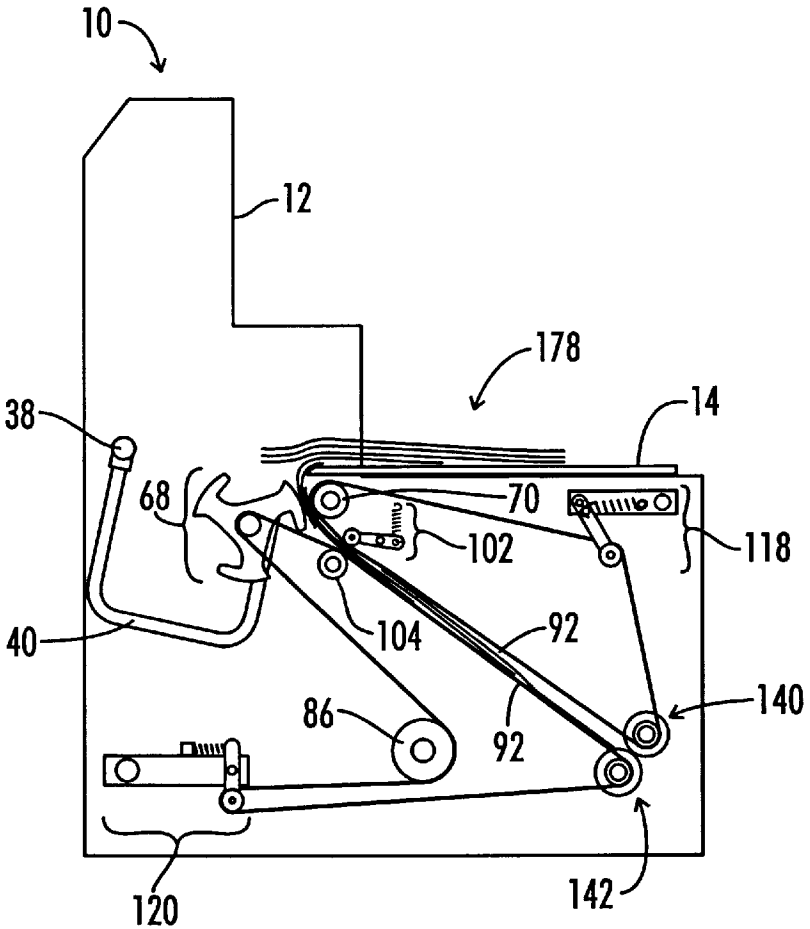

The process performed by the feeding assembly 10 of the present invention is illustrated in FIGS. 1–10. FIGS. 1–2 shows the suction cups 42 engaging and pulling a first insert downward for engagement with the lap rollers 74. The suction cup assembly pulls each insert down approximately 1-'/2 inches. Prior art feeders pull inserts down much farther and, as a result, require different suction levels for inserts with different thicknesses. In contrast, the present invention uses the same suction level to feed inserts having different thicknesses. In FIGS. 3–6, the vacuum for the suction cup assembly is turned off (FIG. 3), the suction cups 42 release the first insert (FIG. 3), the lap rollers 74 push the first insert past the suction cups 42 into engagement with the upper drive rollers 78.(FIGS. 4 and 5), and the lap rollers 74 and the upper drive rollers 78 feed the first insert toward the conveyor belt assembly (FIG. 6). These figures also show the suction cups 42 moving back up to the stack of inserts 178 to retrieve a second insert as soon as the first insert is pushed past the suction cups 42. Because the first insert, and any subsequent insert for that matter, is only required to travel a small distance in order to pass by the suction cups 42. This process can be performed very quickly. As a result, this process allows the feeding assembly 10 of the present invention to operate at very high rates of speed. FIGS. 7–8 show the suction cups 42 engaging a second insert and the lap rollers 74 pressing this second insert against the upper drive rollers 78. FIGS. 9–10 show three overlapping inserts that have been feed into the conveyor belt assembly and a fourth insert being pressed against the upper drive rollers 78 by the lap rollers 74 and fed toward the conveyor belt assembly.

The overlapping stream separating and ejecting assembly separates individual inserts from the stream of overlapping insert arid ejects each individual insert out of the feeding assembly 10. The ejected inserts can be transferred to different kinds of packaging equipment. For example, in one embodiment, the inserts are transferred to a newspaper packaging and distribution system. The overlapping stream separating assembly is located in the lower left-hand portion of the feeding assembly 10 and includes a speed up roller assembly. The speed up roller assembly includes an upper speed up roller assembly 140 and a spring loaded lower speed up roller assembly 142, which allows the roller assembly to adjust for different insert thickness. The upper speed up roller assembly 140 includes an upper speed up roller shaft 144 and speed up rollers 146. The lower speed up roller assembly 142 includes a lower speed up roller shaft 148, lower speed up rollers 150, a lower speed up roller frame 152, and lower speed up roller tensioning springs 154. The upper and lower speed up roller bearings 96 referenced above are located on the upper and lower speed up roller shafts, 144 and 148, respectively.

Figure 12:
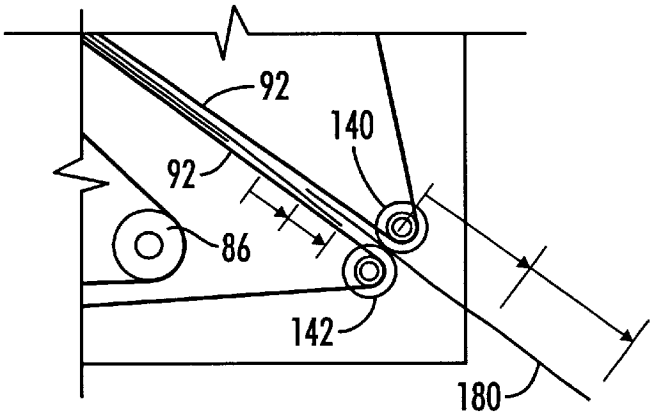
Figure 11:
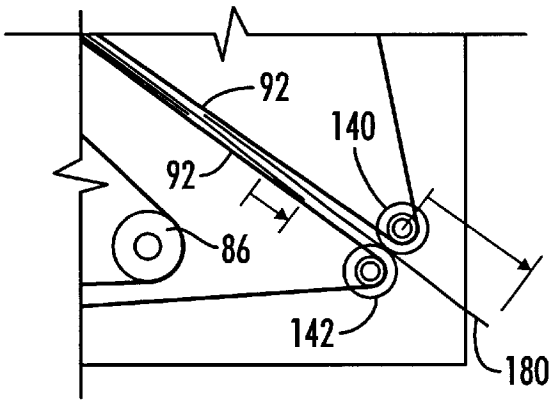
Figure 13:
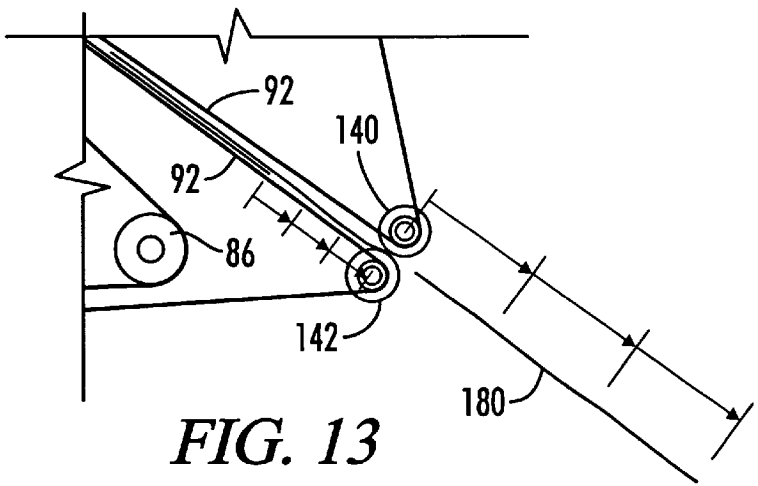

The separating process is illustrated in FIGS. 11–13. In these figures, the 15 upper and lower speed up rollers, 140 and 142, are rotating faster than the conveyor belts 92. As a result, when an insert 180 comes into contact with the upper and lower speed up rollers, 140 and 142, the insert 180 is separated from the other overlapping inserts and ejected from the feeding assembly 10. In FIG. 11, three overlapping inserts are shown with the leading insert 180 extending partially out of the feeding assembly 10. The small arrow indicates the distance traveled by the insert overlapping the leading insert 180 during a specific time period, while the larger arrow shows the distance traveled by the leading insert 180 during the same time period. In this case, the leading insert 180 has traveled almost 3 times farther than the insert overlapping it. FIG. 12 shows the same three overlapping inserts at the end of a second time period. The large and small arrows in this figure once again show the difference caused by the speed up roller assembly in the distance traveled by the leading insert 180 and insert overlapping it. FIG. 13 shows the leading insert 180 ejected by the speed up roller assembly and the insert that had been overlapping it still positioned in the feeding assembly 10.

The speed up roller assembly can be configured to change the 10 amount of overlap in the overlapping stream or to separate the overlapping inserts from one another. The upper speed up roller assembly 140 is located approximately 4 inches from the bottom and approximately 3 inches from the right side of the feeding assembly 10. The lower speed up roller assembly 142 is located approximated 2½ inches from the bottom and 4½ inches from the right side of the feeding assembly 10.

As shown in FIGS. 24 and 26, the lower conveyor belts 92 wrap around the lap roller bearings and travel downward at an approximately 20 degree angle for approximately 3 inches. The belts 92 pass over the top of the lower pinch rollers 116 and continue on at a 40-degree angle toward the lower right portion of the feeding assembly 10. The belts 92 then pass over the lower speed up roller bearings 96 and travel approximately 12 inches to the lower conveyor belt tensioning roller 136. The belts 92 travel back to the right, go under and around the lower drive rollers 100, which drive the lower conveyor belts 92, and travel back approximately 10 inches to tile lap roller bearings.

Referring to FIGS. 25 and 26, the upper conveyor belts 92 wrap around the left and top sides of the upper drive roller assembly 70 between the upper drive rollers 78. The upper drive roller assembly 70 drives the upper conveyor belts 92. The upper conveyor belts 92 travel downward and to the right at a 30 degree angle to the upper tensioning rollers 128. The upper belts 92 continue down to and wrap around the upper speed up bearings 96. The upper belts 92 then travel approximately 11 inches upward and to the left at a 40 degree angle and go under the upper pinch rollers 112. The upper belts 92 continue upward at a 65 degree angle back to the upper drive roller assembly 70.

The main drive assembly drives the converting assembly, conveying assembly, and overlapping stream separating and ejecting assembly. The main drive includes a lower drive roller shaft gear and clutch assembly 154, a 15 lap roller drive assembly gear 158, a lap roller gear 160 on the lap roller shaft 72, an upper drive roller gear 162 on the upper drive roller shaft 76, a lap roller pivot gear 164, and a lap roller drive belt 166. The main drive also includes a speed up roller assembly gear 168, an upper speed up roller gear 170, a speed up roller pivot gear 172, and a speed up roller drive belt 174.

The gear and clutch assembly 154 is a conventional gear and clutch assembly used in the prior art to connect insert feeders to newspaper packaging and distribution systems, such as the NP1472A Inserter manufactured by Heidelberg Finishing Systems, Inc. and referenced previously. In the present invention, the gear and clutch assembly 154 is also used to connect the present invention to newspaper packaging and distribution systems. These systems drive the lower drive roller assembly 86, which, in turn, drives the lap roller drive assembly gear 158 and the speed up roller assembly gear 168. The lap roller drive assembly gear 158, using the lap roller drive belt 166, drives the lap roller assembly 68 and the upper drive roller assembly 70. The lap roller assembly 68 drives the lower conveyor belts 92 and the upper drive roller assembly 70 drives the upper conveyor belts 92. drive assembly drives the conveyor belts 92, lap rollers 74, and the upper drive roller 78 at the same speed. The lap roller drive assembly gear 158 also drives the suction cup assembly because the cam (FIG. 27) is located on the lap roller assembly 68. In a similar manner, the speed up roller assembly gear 168, using the speed up roller drive belt 174, drives the upper speed up roller assembly 140. The gears in the main drive assembly are sized using conventional techniques to ensure that the speed up roller assembly operates at a desired speed greater than the speed of the conveyor belts 92.

Thus, although there have been described particular embodiments of the present invention of a new and useful High Speed Overlapping Insert Feeding Assembly, it is not intended that such references be construed as limitations upon the scope of this invention except as set forth in the following claims.

The invention claimed is:

1. An insert feeding assembly, comprising:

supporting means for supporting a stack of inserts;

converting means for converting the stack of inserts into an overlapping stream of inserts with a lap roller assembly that guides each insert down into the overlapping stream of inserts;

conveying means for conveying the overlapping stream through the feeding assembly; and overlapping stream separating and ejecting means for separating individual inserts from the overlapping stream of inserts and for ejecting separated individual inserts from the feeding assembly.

2. The assembly of claim 1, wherein the converting means includes:

stacking separate means for separating individual inserts from the stack of inserts; and overlapping and guiding means for overlapping and guiding the separated inserts to the conveying means.

3. The assembly of claim 2, wherein the conveying means includes a conveyor belt assembly, the conveyor belt assembly further including upper and lower conveyor belt assemblies.

4. The assembly of claim 3, wherein the overlapping stream separating and ejecting means includes a speed up roller assembly, the speed up roller assembly including upper and lower speed up roller assemblies.

5. The assembly of claim 4, wherein the stack separating means includes a suction cup assembly.

6. The assembly of claim 5, wherein the overlapping and guiding means includes a lap roller drive assembly.

7. The assembly of claim 6, wherein the lap roller drive assembly includes the lap roller assembly and an upper drive roller assembly, the lap roller assembly including a lap roller shaft having a plurality of lap rollers, each lap roller including a plurality of bent finger shaped structures.

8. The assembly of claim 7, wherein the upper drive roller assembly, the upper conveyor belt assembly, the lower conveyor belt assembly, and the lower speed up roller assembly include insert thickness adjustment means for feeding inserts having different thickness.

9. An assembly for feeding inserts comprising:

an insert supporting assembly;

a converting assembly adjacent to the insert supporting assembly, where the converting assembly uses a lap roller assembly configured to guide each insert down into an overlapping stream of inserts;

a conveying assembly adjacent to the converting assembly; and an overlapping stream separating and ejecting assembly adjacent to the conveying assembly.

10. The assembly of claim 9, wherein the converting assembly includes:

a stack separating assembly; and an overlapping and guiding assembly adjacent to the stack separating assembly.

11. The assembly of claim 10, wherein the conveying assembly includes a conveyor belt assembly, the conveyor belt assembly further including upper and lower conveyor belt assemblies.

12. The assembly of claim 11, wherein the overlapping stream separating and ejecting assembly includes a speed up roller assembly, the speed up roller assembly including upper and lower speed up roller assemblies.

13. The assembly of claim 12, wherein the stack separating assembly includes a suction cup assembly.

14. The assembly of claim 13, wherein the overlapping and guiding assembly includes a lap roller drive assembly.

15. The assembly of claim 14, wherein the lap roller drive assembly includes the lap roller assembly and an upper drive roller assembly, the lap roller assembly including a lap roller shaft having a plurality of lap rollers, each lap roller including a plurality of bent finger shaped structures.

16. The assembly of claim 15, wherein the upper drive roller assembly, the upper conveyor belt assembly, the lower conveyor belt assembly, and the lower speed up roller assembly include insert thickness adjustment means for feeding inserts having different thickness.

17. A method of feeding inserts using a feeder, comprising the steps for:

placing a stack of inserts into an insert support;

converting a stack of inserts into an overlapping stream of inserts using a lap roller drive assembly, where the lap roller drive assembly guides each insert down into an overlapping stream of inserts;

conveying the overlapping stream through the feeder using a conveying assembly; and separating and ejecting individual inserts from the overlapping stream of inserts out of the feeder using an overlapping stream separating and ejecting assembly.

18. The method of claim 17, wherein the steps for:

separating individual inserts from the stack of inserts; and overlapping and guiding the separated inserts to the conveying assembly.

19. The method of claim 18, wherein the step for conveying includes the step for moving the overlapping stream of inserts through the feeder using a conveyor belt assembly having upper and lower belt assemblies.

20. The method of claim 19, wherein the step for separating and ejecting includes the step for moving the overlapping stream of inserts into a speed up roller assembly having upper and lower belt assemblies.

21. The method of claim 20, wherein the step for separating includes the step of for separating individual inserts from the stack using a suction cup assembly.

22. The method of claim 21, wherein the step for overlapping and guiding includes the step for overlapping and guiding individual inserts with a lap roller drive assembly.

23. The method of claim 22, wherein the step for overlapping and guiding includes the step for overlapping and guiding individual inserts with a lap roller drive assembly and an upper drive roller assembly, the lap roller drive assembly including a lap roller shaft having a plurality of lap rollers, each lap roller including a plurality of bent finger shaped structures.

24. The method of claim 23, wherein:

the step for overlapping and guiding includes the step for overlapping and guiding individual inserts with an upper drive roller assembly having an upper drive roller insert thickness adjustment assembly;

the step for moving the overlapping stream of inserts through the feeder using upper and lower belt assemblies includes the step for moving the overlapping stream of inserts through the feeder using an upper conveyor belt assembly having an upper conveyor belt inset thickness adjustment assembly and a lower conveyor belt assembly having a lower conveyor belt insert thickness adjustment assembly; and the step for moving the overlapping stream of inserts into a lower speed up roller assembly includes the step of moving the overlapping stream of inserts into a lower speed up roller assembly having a lower speed up roller insert thickness adjustment assembly.

* * * * *